US011842688B1

(12) United States Patent
Qiu et al.

(10) Patent No.: US 11,842,688 B1
(45) Date of Patent: Dec. 12, 2023

(54) BACKLIGHT MODULE, DRIVING METHOD AND DISPLAY DEVICE THEREOF

(71) Applicant: HKC CORPORATION LIMITED, Shenzhen (CN)

(72) Inventors: Bin Qiu, Shenzhen (CN); Rongrong Li, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/065,328

(22) Filed: Dec. 13, 2022

(30) Foreign Application Priority Data

Jun. 16, 2022 (CN) ..... 202210677882.X

(51) Int. Cl.
*G09G 3/34* (2006.01)
*G09G 3/325* (2016.01)

(52) U.S. Cl.
CPC ..... *G09G 3/325* (2013.01); *G09G 2310/08* (2013.01)

(58) Field of Classification Search
CPC .. G09G 3/325; G09G 2310/08; G09G 3/3426; G09G 3/36; G09G 2320/0257; G09G 2320/0686; G09G 3/32; G09G 2300/0426; G09G 2310/024; G09G 2310/06; G09G 2310/067; G09G 2320/0209; G09G 2320/064
See application file for complete search history.

(56) References Cited

U.S. PATENT DOCUMENTS 10,878,752 B1 12/2020 Li et al.
2008/0094006 A1* 4/2008 Ye ..... G09G 3/3426 315/294

(Continued)

FOREIGN PATENT DOCUMENTS

CN 103310735 9/2013
CN 111354298 6/2020

(Continued)

OTHER PUBLICATIONS

CNIPA, First Office Action for CN Application No. 202210677882.X, dated Jul. 22, 2022.

*Primary Examiner* — Md Saiful A Siddiqui
(74) *Attorney, Agent, or Firm* — Hodgson Russ LLP

(57) ABSTRACT

A backlight module includes at least one light-emitting group, each of which comprises a main drive unit provided with a plurality of main signal transmission channels and a plurality of groups of light-emitting units. Each of the main signal transmission channels is connected to a group of the light-emitting units. The backlight module further includes an auxiliary drive unit and a controller connected to the main drive unit and the auxiliary drive unit. The auxiliary drive unit provided with a plurality of auxiliary signal transmission channels and the main drive unit are connected in parallel, the auxiliary signal transmission channels and the main signal transmission channels are arranged in parallel in one-to-one correspondence and connected to the group of light-emitting units. The controller is configured to control operating states of the main signal transmission channel and the auxiliary signal transmission channel according to a refresh frequency and gray-scale data.

15 Claims, 8 Drawing Sheets

(56) References Cited

U.S. PATENT DOCUMENTS

| | | | | |
|---|---|---|---|---|
| 2015/0042233 | A1* | 2/2015 | Zhang | H05B 45/38 315/192 |
| 2016/0232832 | A1* | 8/2016 | Kang | G09G 3/2014 |
| 2021/0383768 | A1 | 12/2021 | Cao et al. | |

FOREIGN PATENT DOCUMENTS

| | | |
|---|---|---|
| CN | 111754937 | 10/2020 |
| CN | 112201201 | 1/2021 |
| CN | 112382638 | 2/2021 |
| CN | 212724664 | 3/2021 |
| CN | 113643663 | 11/2021 |

* cited by examiner

BACKLIGHT MODULE, DRIVING METHOD AND DISPLAY DEVICE THEREOF

CROSS-REFERENCE TO RELATED APPLICATIONS

This application claims priority to Chinese Patent Application No. 202210677882.X, filed Jun. 16, 2022, the entire disclosure of which is incorporated herein by reference.

FIELD OF TECHNOLOGY

The present application relates to the field of display technology, in particular to a backlight module, a driving method thereof and a display device.

BACKGROUND

In the backlight module of the display panel, more and more display products are using MiniLED (Mini light-emitting Diode) as the backlight display. There are more and more front-end display products with MiniLED backlight, and the refresh frequency is gradually increasing. However, the refresh frequency of current LED driver is low, which cannot meet the increasingly high refresh frequency requirements. In addition, in the gray-scale data for driving the backlight module to operate, the number of bits of gray-scale data exceeds the upper limit of the number of bits of current change in a single signal transmission conduction, which will also lead to some brightness values in the backlight brightness that cannot be reached, which will affect the display effect of the backlight module.

The above information disclosed in the Background is only for enhancement and primarily serves to diminish understanding of the background of the present application, and therefore it may include information that does not constitute prior art known to a person of ordinary skill in the art.

SUMMARY

There are provided a backlight module, a driving method thereof and a display device according to embodiments of the present application. The technical solution is as below:

According to a first aspect of the present application, there is provided a backlight module, including:

at least one light-emitting group, each of which comprises a main drive unit provided with a plurality of main signal transmission channels and a plurality of groups of light-emitting units, each of the main signal transmission channels being connected to a group of the light-emitting units, an auxiliary drive unit, wherein the auxiliary drive unit and the main drive unit are connected in parallel, the auxiliary drive unit is provided with a plurality of auxiliary signal transmission channels, the auxiliary signal transmission channels and the main signal transmission channels are arranged in parallel in one-to-one correspondence and are connected to the group of light-emitting units; and a controller connected to the main drive unit and the auxiliary drive unit, respectively, and configured to control operating states of the main signal transmission channel and the auxiliary signal transmission channel according to a refresh frequency and gray-scale data.

According to a second aspect of the present application, there is provided a driving method of a backlight module, the backlight module includes at least one light-emitting group, the light-emitting group including a main drive unit provided with a plurality of main signal transmission channels and an auxiliary drive unit provided with a plurality of auxiliary signal transmission channels, the auxiliary signal transmission channels and the main signal transmission channels being arranged in parallel in one-to-one correspondence and connected to a same group of light-emitting units; the driving method of the backlight module includes:

obtaining a comparison result by comparing values of a refresh frequency at which the backlight module is lit and a rated refresh frequency of the main drive unit, and obtaining a comparison result by comparing number of bits of a gray-scale data when the backlight module is lit with number of bits of a gray-scale value corresponding to a current change bit of the main signal transmission channel; and controlling operating states of the main signal transmission channel and the auxiliary signal transmission channel according to the comparison result between the refresh frequency and the rated refresh frequency of the main drive unit and the comparison result between the gray-scale data and the gray-scale value corresponding to the current change bit of the main signal transmission channel.

According to a third aspect of the present application, there is provided a display device, the display device includes a display screen and a backlight module as described above, the backlight module is disposed at one side of the display screen, the display device further includes a power module connected to a controller and the display screen, respectively and configured to provide power for the display screen and the backlight module.

It should be understood that the above general description and the following detailed description are exemplary only and are not limiting to the present application.

BRIEF DESCRIPTION OF THE DRAWINGS

The above and other objects, features and advantages of the present application will become more apparent by describing exemplary embodiments thereof in detail with reference to the accompanying drawings.

DETAILED DESCRIPTION OF THE EMBODIMENTS

Figure 1:
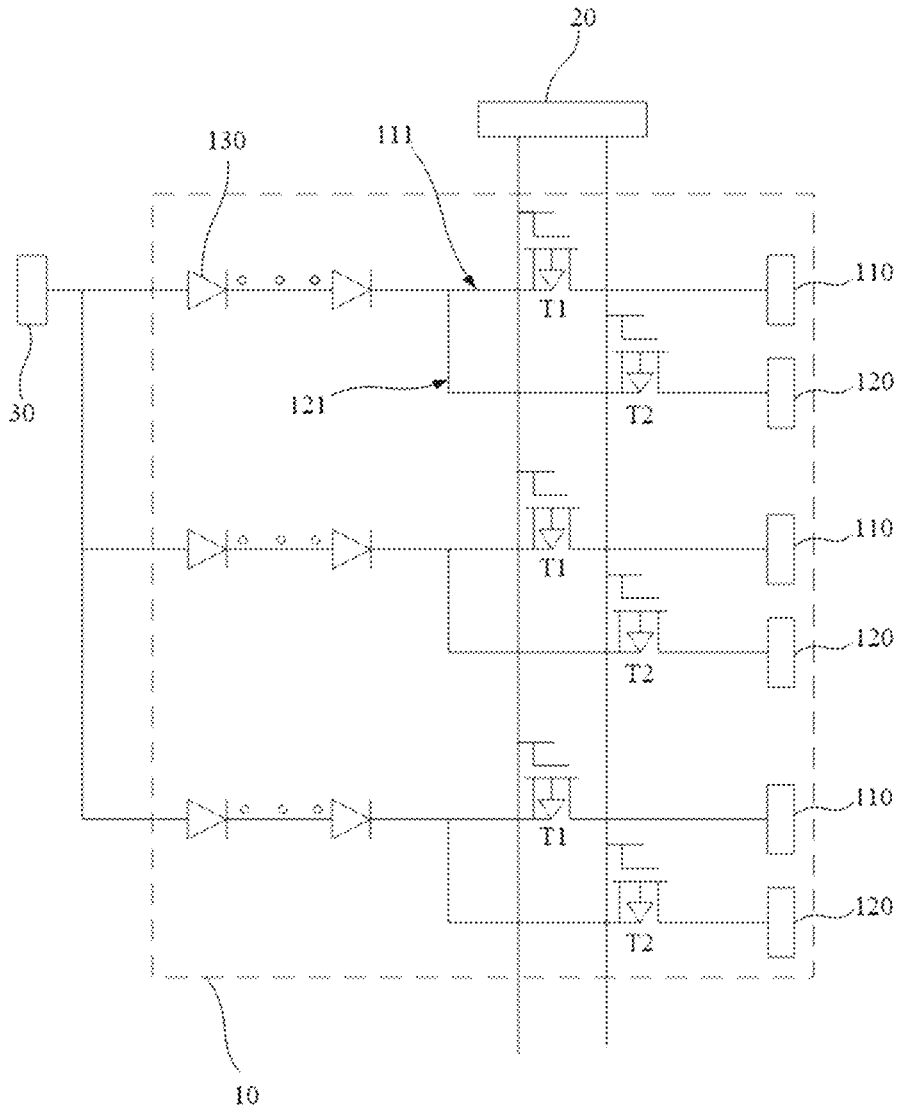
FIG. 1 is a diagram of circuit connection of a backlight module according to a first embodiment of the present application.

Although the present application can readily be embodied in different forms of embodiment, however, only some of the specific embodiments are shown in the drawings and will be described in detail in the description, while it is understood that the description is to be regarded as an exemplary illustration of the principles of the present application and is not intended to limit the present application to those described herein.

Thus, one feature pointed out in the description is intended to illustrate one of the features of one embodiment of the present application and is not intended to imply that each embodiment of the present application must possess the illustrated feature. In addition, it should be noted that many features are described in the description. Although certain features may be combined to illustrate a possible system design, these features may also be used for other unspecified combinations. Therefore, unless otherwise stated, the illustrated combinations are not intended to be limiting.

In the embodiments illustrated in the drawings, indications of direction (such as up, down, left, right, front and back) are used to explain that the structure and movement of the various elements of the present application are not absolute but relative. These descriptions are appropriate when these elements are in the positions shown in the drawings. If the description of the positions of the element changes, the indications of the directions change accordingly.

Exemplary embodiments will now be described more comprehensively with reference to the accompanying drawings. However, the exemplary embodiments can be implemented in a variety of forms and should not be construed as being limited to the examples set forth herein. Rather, these exemplary embodiments are provided so that the description of the present application will be more comprehensive and complete, and the concept of exemplary embodiments will be fully connected to those skilled in the art. The accompanying drawings are only schematic illustrations of the present application and are not necessarily drawn to scale. Like reference signs in the drawings denote identical or similar parts and thus repetitive descriptions thereof will be omitted.

The preferred embodiments of the present application are further elaborated below in conjunction with the accompanying drawings of the description.

Embodiment 1

Referring to FIG. 1, the embodiment provides a backlight module. The backlight module in this embodiment adopts MiniLED (Mini light-emitting Diode), which adopts straight-down type design with small spacing of lamp beads, and achieves dimming in a smaller area through a large number of dense beads. Compared with the traditional backlight design, Mini LED can have better brightness uniformity and higher color contrast in a smaller lights-mixing distance, and can achieve ultra-thin design of end products and save electric energy. However, the existing driver chips has limited ability for the backlight module to light up and refresh, and some signals with higher refresh frequency are difficult to complete lighting and refresh completely in the backlight module.

To this end, the embodiment provides a backlight module. The backlight module includes at least one light-emitting group 10. Each light-emitting group 10 includes a main drive unit 110 and a plurality of groups of light-emitting units 130. The main drive unit 110 is provided with a plurality of main signal transmission channels 111, and each of the main signal transmission channels 111 is connected to a group of light-emitting units 130. The group of light-emitting units 130 may be understood as a single miniature light-emitting diode or as a lamp string 131 composed of a plurality of miniature light-emitting diodes in series.

The light-emitting group 10 further includes an auxiliary drive unit 120. The auxiliary drive unit 120 is connected with the main drive unit 110 in parallel. The auxiliary drive unit is provided with a plurality of auxiliary signal transmission channels 121. The auxiliary signal transmission channels 121 are arranged in parallel one by one with the main signal transmission channels 111 and connected to the same group of light-emitting units 130. The cascade of the auxiliary drive unit 120 and the main drive unit 110 can be understood as the two being arranged in parallel. Thus, the corresponding auxiliary signal transmission channel 121 and the main signal transmission channel 111 are connected in parallel with each other. The number of main signal transmission channels 111 corresponds to the corresponding number of auxiliary signal transmission channels 121 to ensure one-to-one correspondence. Both the main drive unit 110 and the auxiliary drive unit 120 can be understood as driver chips, and the size, specifications and parameters of the main drive unit 110 and the auxiliary drive unit 120 are the same.

The backlight module further includes a controller 2. The controller 2 is connected to the main drive unit 110 and the auxiliary drive unit 120, and the controller 2 is used for controlling the operating states of the main signal transmission channel 111 and the auxiliary signal transmission channel 121 according to the acquired refresh frequency and gray-scale data. The refresh frequency refers to the number of times the light-emitting unit 130 in the backlight module is lit per unit time, i.e., how many frames are refreshed in one second. For example, when the refresh frequency is 240 Hz, 240 frames are refreshed within 1 second. If the refresh frequency exceeds the rated refresh frequency of the refresh of the backlight module, 240 Hz is split into two 120 Hz, one of which is refreshed through the main signal transmission channel 111 and the other 120 Hz through the auxiliary signal transmission channel 121.

The gray-scale data refers to the change from black to white of the light-emitting unit 130 and mainly shows the brightness of the light-emitting unit 130. Generally speaking, gray-scale data is selected between 2 to the 8th power, namely 256 data, that is, the number between 0 and 255, where 0 stands for black and 255 stands for white. But sometimes the number of gray-scale bits is 10, then the number of gray-scale data is 1024, which exceeds the order of current change in the main signal transmission channel 111. In this way, the main drive unit 110 and the auxiliary drive unit 120 are used in parallel, which is equivalent to the superposition of two 2 to the 8th power. That is, 2 to the 16th power, with a total of 65,536 gray-scale data. In this case, all the 10-bit gray-scale data can be displayed, which improves the ability of current change and makes the distinction between black and white brightness more detailed. It should be noted that the main signal transmission channel 111 and the auxiliary signal transmission channel 121 shunt the current, and the current in the two signal transmission channels may be equal, or the current in one channel may be large and the current in the other channel may be small.

An anode of the light-emitting unit 130 is connected to a power module 30, a cathode of the light-emitting unit 130 is connected to the main drive unit 110 and the auxiliary drive unit 120, and the power module 30 is used for supplying electric power.

In the technical solution of this embodiment, two main drive units 110 and auxiliary drive units 120 in parallel are arranged in one light-emitting group 10. When the refresh frequency at which the light-emitting diode is driven to operate exceeds the upper limit, the main signal transmission channel 111 and the auxiliary signal transmission channel 121 are controlled to be communicated in time sequence by the controller 2. Thus, a part of the refresh frequency is refreshed through the main signal transmission channel 111 when the main drive unit 110 and the light-emitting unit 130 are communicated, and another part of the refresh frequency is refreshed through the auxiliary signal transmission channel 121 when the auxiliary drive unit 120 and the light-emitting unit 130 are communicated. Therefore, the refresh frequency of the backlight module is improved.

In addition, when the number of bits of gray-scale data when the backlight module is driven to operate light exceeds the upper limit of the number of bits of current change in a single signal transmission conduction, the main signal transmission channel 111 and the auxiliary signal transmission channel 121 are controlled to be communicated simultaneously by the controller 2. In this way, the main drive unit 110 and the auxiliary drive unit 120 participate in the operation simultaneously, and the current change bits of the auxiliary signal transmission channel 121 are superimposed on the basis of the current change bits of the main signal transmission channel 111. The upper limit value of current change bit in backlight module is improved. Therefore, the upper gray-scale limit of the gray-scale data at which backlight module is driven to operate can be met.

In the above embodiment, in order to better control the conduction of the main signal transmission channel 111 and the auxiliary signal transmission channel 121, in a main signal transmission channel 111 and an auxiliary signal transmission channel 121 arranged in parallel in one-to-one correspondence, the main signal transmission channel 111 is connected to the light-emitting unit 130 through a first control switch T1, and the auxiliary signal transmission channel 121 is connected to the light-emitting unit 130 through a second control switch T2. The main signal transmission channel 111 and the auxiliary signal transmission channel 121 are turned on or off by the controller 2 controlling the first control switch T1 and the second control switch T2.

The controller 2 is respectively connected to the first control switch T1 and the second control switch T2, and is configured for controlling switching states of the first control switch T1 and the second control switch T2 according to the refresh frequency and gray-scale data, so as to adjust the operating states of the main signal transmission channel 111 and the auxiliary signal transmission channel 121.

When the refresh frequency is greater than the rated refresh frequency of the backlight module, the controller 2 controls the first control switch T1 and the second control switch T2 to be turned on in time sequence. First, the first control switch T1 is turned on and the second control switch T2 is turned off. At this time, the main signal transmission channel 111 and the light-emitting unit 130 are communicated, and the main signal transmission channel 111 transmits current to complete refresh of one frame. Then, the first control switch T1 is turned off and the second control switch T2 is turned on. At this time, the auxiliary signal transmission channel 121 and the light-emitting unit 130 are communicated, and the auxiliary signal transmission channel 121 transmits current to complete refresh of one frame. Thus, the main signal transmission channel 111 and the auxiliary signal transmission channel 121 alternately communicate with the light-emitting unit 130, and a part of the refresh frequency is refreshed via the main signal transmission channel 111 and the other part of the refresh frequency is refreshed via the auxiliary signal transmission channel 121.

Further, the first control switch T1 and the second control switch T2 are both transistor switches.

A first terminal of the first control switch T1 is connected to the light-emitting unit 130, a second terminal of the first control switch T1 is connected to the main drive unit 110, and a control terminal of the first control switch T1 is connected to the controller 2.

A first terminal of the second control switch T2 is connected to the light-emitting unit 130, a second terminal of the second control switch T2 is connected to the auxiliary drive unit 120, and a control terminal of the second control switch T2 is connected to the controller 2.

The first control switch T1 and the second control switch T2 may be a P-type transistor switch or an N-type transistor switch. When the first control switch T1 is a P-type transistor switch, the controller 2 outputs a low level to the first control switch T1, the first terminal and the second terminal of the first control switch T1 are turned on. When the controller 2 outputs a high level, the first terminal and the second terminal of the first control switch T1 are turned off. When the first control switch T1 is an N-type transistor switch, the controller 2 outputs a high level to the first control switch T1, the first terminal and the second terminal of the first control switch T1 are turned on. When the controller 2 outputs a low level, the first terminal and the second terminal of the first control switch T1 are turned off. Similarly, the case where the second control switch T2 is a P-type transistor switch or an N-type transistor switch can be implemented by referring to the embodiment of the first control switch T1.

It should be noted that the control terminal is a gate, the first terminal can be a source, and the second terminal is a drain. Alternatively, the first terminal is a drain, and the second terminal is a source.

Figure 2:
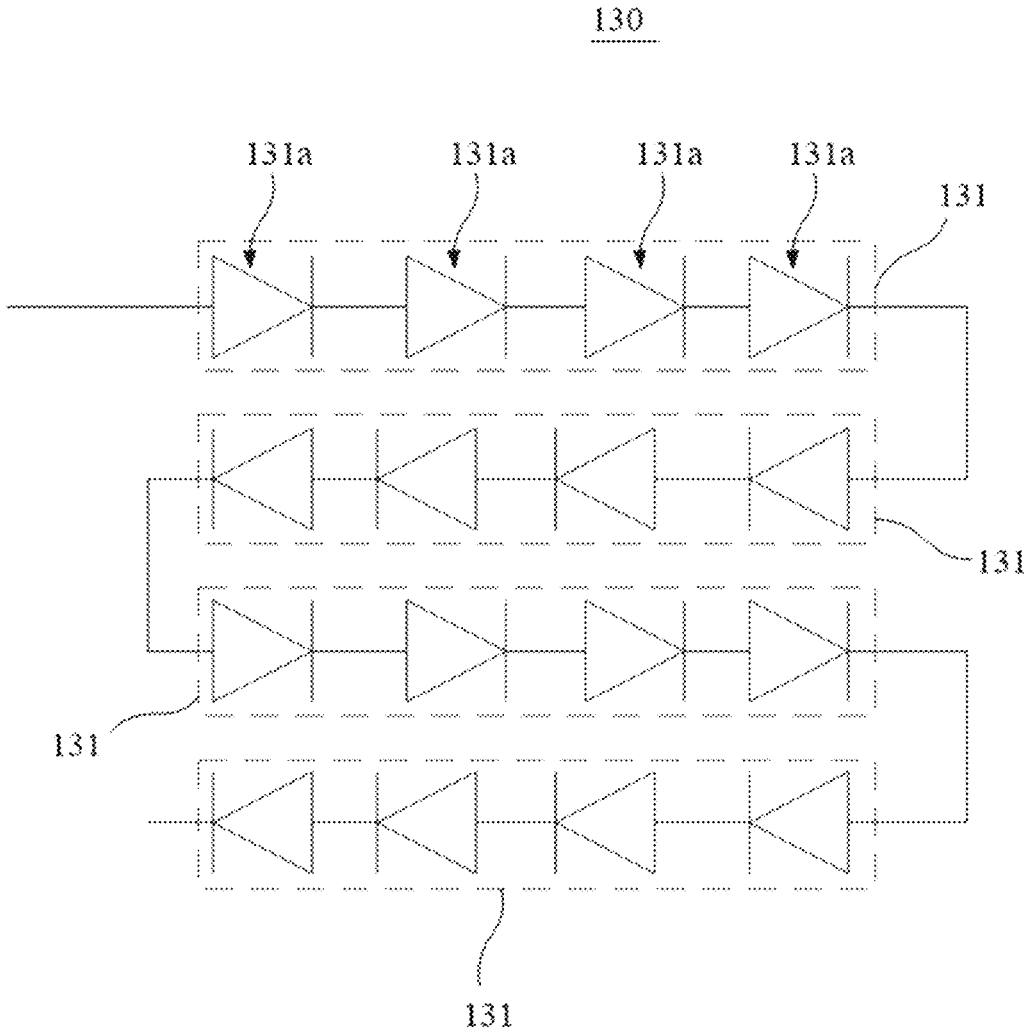
FIG. 2 is a schematic diagram of connection of light-emitting unit in FIG. 1 in the present application.

Referring to FIG. 2, in order to improve the uniformity of light-emitting of the backlight module, the light-emitting unit 130 includes a plurality of groups of lamp strings 131 arranged side by side, two adjacent lamp strings 131 are arranged equidistantly, and the two adjacent lamp strings 131 are connected end to end. It can be seen that the lamp strings 131 in the light-emitting unit 130 are connected in a circuitous end-to-end fashion. In addition, through the equidistant arrangement, the distances between each two group of lamp strings 131 are equal, so that when the lamp strings 131 are lit, the situation that the local brightness is too bright and other parts may be too dim will not occur.

In order to improve the brightness of the backlight module, the lamp string 131 includes a plurality of lamp beads 131*a*, and the plurality of lamp beads 131*a* are sequentially connected in series. The distance between the pixel centers of two adjacent lamp beads 131*a* is L, which satisfies: 0.3 mm≤L≤1.5 mm. If the pixel center distance of the two lamp beads 131*a* is less than 0.3 mm, two adjacent lamp beads 131*a* may interfere with each other. If the pixel center distance between the two lamp beads 131*a* is greater than 1.5 mm, the distance between the adjacent two lamp beads 131*a* is too far to waste the arrangement space. Accordingly, the distance between the two lamp beads 131*a* is small enough so that a large number of MiniLED lamps can be closely arranged in the backlight local area. Also, the backlight brightness is improved.

Figure 3:
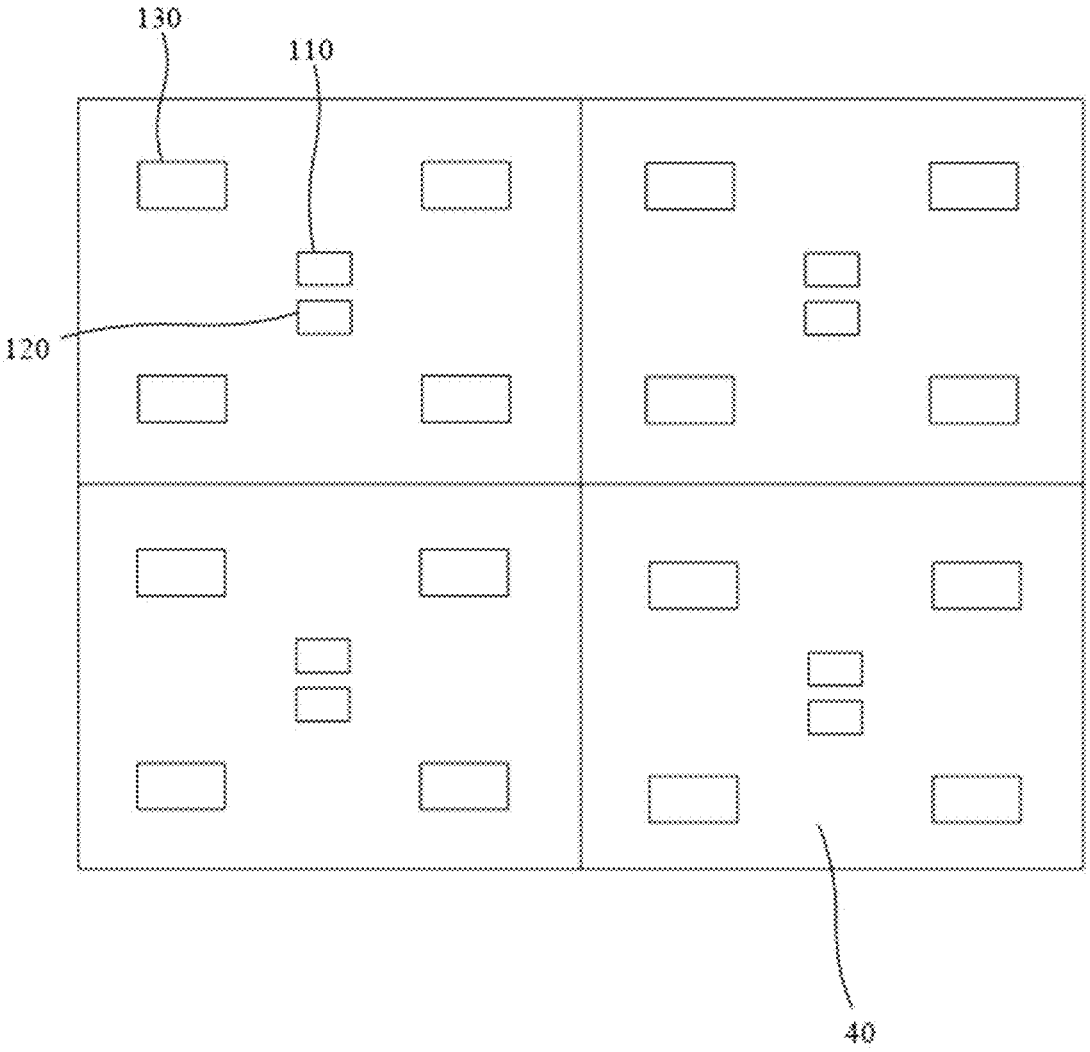
FIG. 3 is a structural schematic diagram of a main drive unit, an auxiliary drive unit and the light-emitting unit located on the backplane in this application.

Referring to FIG. 3, the backlight module includes a backplate 40, which are equally divided into backlight areas, and each backlight area is provided with a group of light-emitting groups 10. It can be seen that two drive units, namely the main drive unit 110 and the auxiliary drive unit 120, are provided in each light-emitting group 10.

Figure 4:
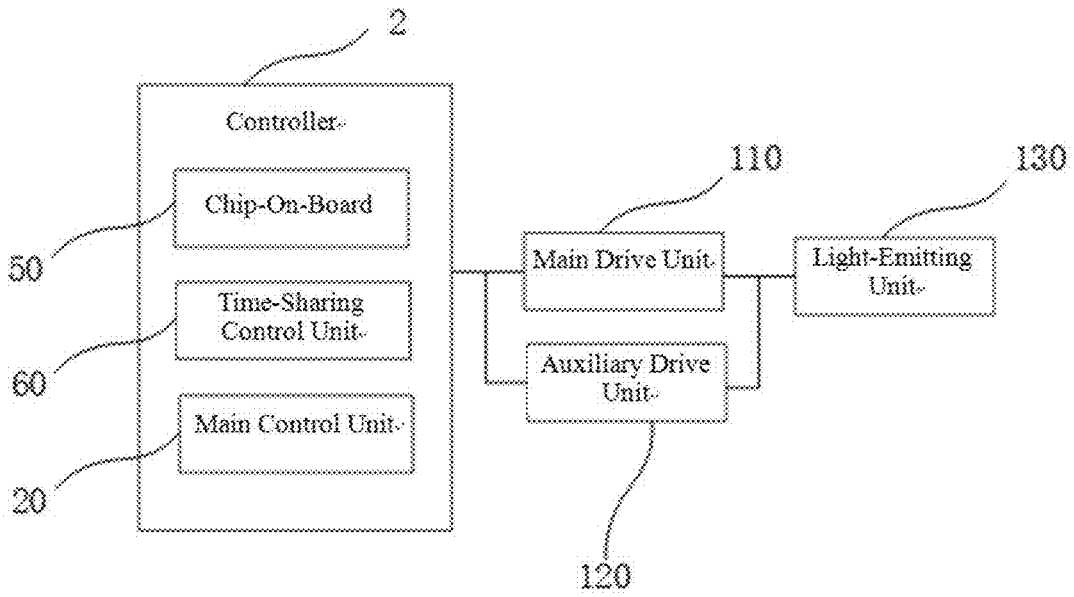
FIG. 4 is a schematic structural diagram of a controller connecting drive unit and the light-emitting unit in the present application.

Referring to FIG. 4, the driving device includes the controller 2. The controller 2 includes a chip-on-board plate 50, a time-sharing control unit 60, and a main control unit 20. The time-sharing control unit 60 is connected to the chip-on-board plate 50 and the main control unit 20, respectively.

The chip-on-board plate 50 is used for acquiring a data signal for lighting the backlight module.

The time-sharing control unit 60 is used for analyzing the data signal, and extracting the refresh frequency at which the backlight module is lit and the gray-scale data of the backlight module from the data signal, and comparing values of the refresh frequency at which the backlight module is lit and a rated refresh frequency of the main drive unit 110, and comparing number of bits of a gray-scale data when the backlight module is lit with number of bits of a gray-scale value corresponding to a current change bit of the main signal transmission channel 111.

The main control unit 20 is used for controlling the operating states of the main signal transmission channel 111 and the auxiliary signal transmission channel 121 according to the comparison result between the refresh frequency and the rated refresh frequency of the main drive unit 110 and the comparison result between the gray-scale data and the gray-scale value corresponding to the current change bit of the main signal transmission channel 111.

In this embodiment, a data signal is acquired through the chip-on-board plate 50. The time-sharing control unit 60 completes the analysis and processing of the data signal, extracts the gray-scale data and the refresh frequency, and completes the comparison of the refresh frequency and the rated refresh frequency of the main drive unit 110, and the comparison of the gray-scale data lit by the backlight module and the gray-scale value corresponding to the current change bit of the main signal transmission channel 111. A signal of comparison result is transmitted to the main control unit, and the main control unit 20 controls the operating states of the main signal transmission channel 111 and the auxiliary signal transmission channel 121, and completes the sequential conduction of the main signal transmission channel 111 and the auxiliary signal transmission channel 121 or the simultaneous conduction of the main signal transmission channel 111 and the auxiliary signal transmission channel 121.

Embodiment 2

Figure 5:
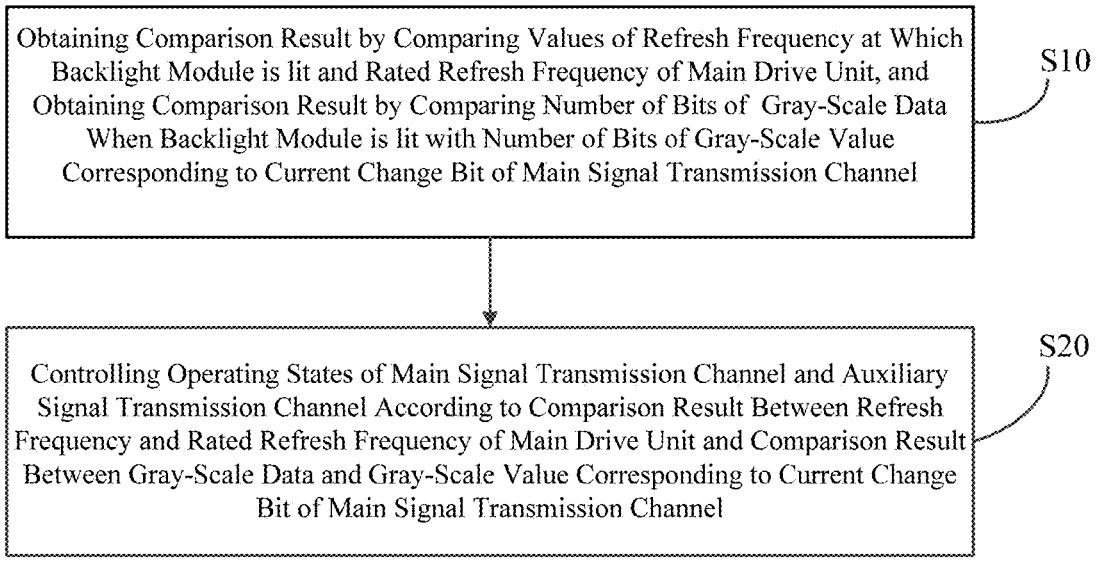
FIG. 5 is a flow diagram of a driving method of a backlight module according to a second embodiment of the present application.

Referring to FIG. 5, the present application also provides a driving method of a backlight module. The backlight module includes at least one light-emitting group 10, which includes a main drive unit 110 and an auxiliary drive unit 120. The main drive unit 110 is provided with a plurality of main signal transmission channels 111. The auxiliary drive unit 120 is provided with a plurality of auxiliary signal transmission channels 121, and the auxiliary signal transmission channels 121 and the main signal transmission channels 111 are arranged in parallel in one-to-one correspondence, and are connected to the same group of light-emitting units 130.

The driving method of the backlight module includes:

Step S10, obtaining a comparison result by comparing values of a refresh frequency at which the backlight module is lit and a rated refresh frequency of the main drive unit, and obtaining a comparison result by comparing number of bits of a gray-scale data when the backlight module is lit with number of bits of a gray-scale value corresponding to a current change bit of the main signal transmission channel; and Step S20, controlling operating states of the main signal transmission channel and the auxiliary signal transmission channel according to the comparison result between the refresh frequency and the rated refresh frequency of the main drive unit and the comparison result between the gray-scale data and the gray-scale value corresponding to the current change bit of the main signal transmission channel. Displaying gray-scale data or refreshing through the refresh frequency in the backlight module can be accomplished by controlling the operating states of the main signal transmission channel and the auxiliary signal transmission channel. Specifically, the sequential conduction of the main signal transmission channel and the auxiliary signal transmission channel is controlled according to the refresh frequency. According to the gray-scale data, both the main signal transmission channel and the auxiliary signal transmission channel are controlled to be conductive.

In the technical solution of this embodiment, two main drive units and auxiliary drive units in parallel are arranged in one light-emitting group. When the refresh frequency at which the LED is driven to operate exceeds the driving upper limit, the controller controls the main signal transmission channel and the auxiliary signal transmission channel to communicate in time sequence. Thus, a part of the refresh frequency is refreshed through the main signal transmission channel when the main drive unit and the light-emitting unit are communicated, and another part of the refresh frequency is refreshed through the auxiliary signal transmission channel when the auxiliary drive unit and the light-emitting unit are communicated. Therefore, the refresh frequency exceeding the rated refresh frequency of the backlight module can be refreshed.

In addition, when the number of bits of gray-scale data when the backlight module is driven to operate light exceeds the upper limit of the number of bits of current change in a single signal transmission conduction, the main signal transmission channel and the auxiliary signal transmission channel are controlled to communicate simultaneously by the controller. In this way, the main drive unit and the auxiliary drive unit participate in the operation simultaneously, and the current change bits of the auxiliary signal transmission channel are superimposed on the basis of the current change bits of the main signal transmission channel. The upper limit value of current change bit in backlight module is improved. Therefore, the upper gray-scale limit of the gray-scale data at which backlight module is driven to operate can be met.

Figure 6:
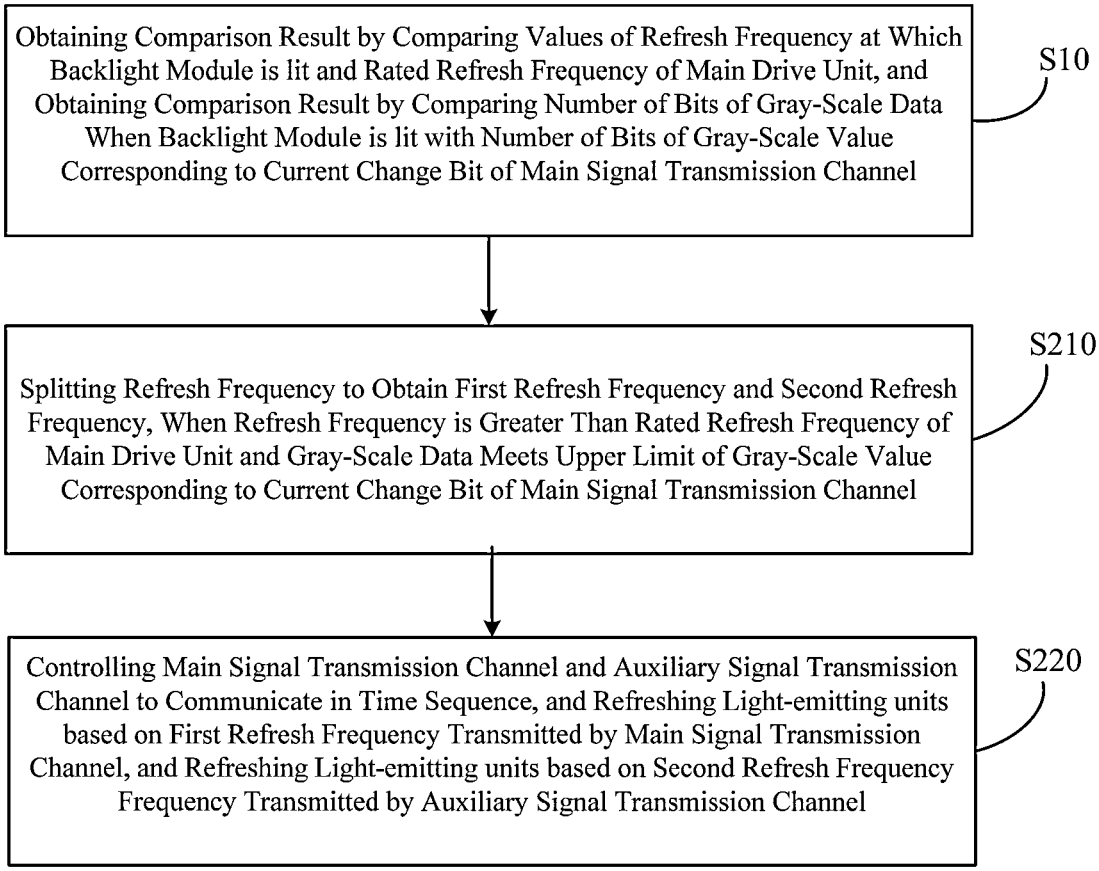
FIG. 6 is a flow diagram of step S20 in the present application.

Referring to FIG. 6, the step of controlling operating states of the main signal transmission channel and the auxiliary signal transmission channel according to the comparison result between the refresh frequency and the rated refresh frequency of the main drive unit and the comparison result between the gray-scale data and the gray-scale value corresponding to the current change bit of the main signal transmission channel includes:

Step S210, splitting the refresh frequency to obtain a first refresh frequency and a second refresh frequency, when the refresh frequency is greater than the rated refresh frequency of the main drive unit and the gray-scale data meets an upper limit of the gray-scale value corresponding to the current change bit of the main signal transmission channel; and Step S220, controlling the main signal transmission channel and the auxiliary signal transmission channel to communicate in time sequence, and refreshing the light-emitting units based on the first refresh frequency transmitted by the main signal transmission channel, and refreshing the light-emitting units based on the second refresh frequency transmitted by the auxiliary signal transmission channel.

Figure 9:
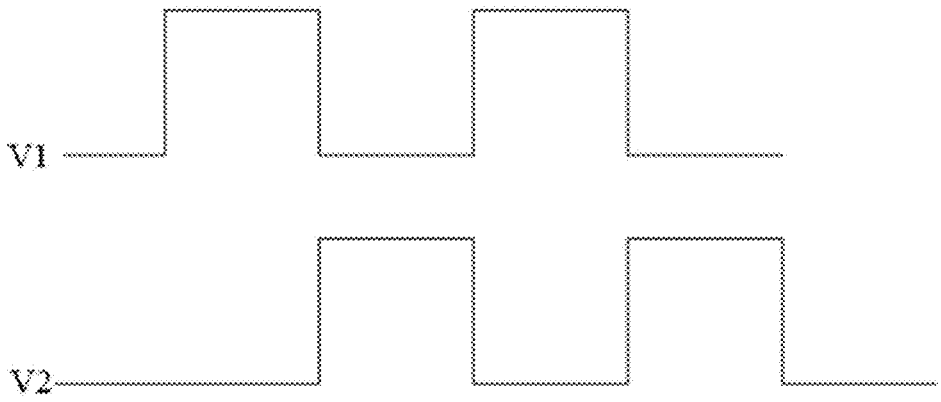
FIG. 9 is a timing diagram of step S220 in the present application.

Accordingly, in this embodiment, only one of the refresh frequency and the gray-scale data exceeds the lighting ability of the backlight module. That is to say, the main signal transmission channel and the auxiliary signal transmission channel have only two operating states. As can be seen in conjunction with FIG. 9, one of the operating states is sequential operation, that is, one signal transmission channel is turned on and the other is turned off. The main control unit outputs a control signal V1 to the first control switch, and the main signal transmission channel is turned on. The main control unit outputs a control signal V2 to the second control switch, and the auxiliary signal transmission channel is turned on. Frequency refresh is completed in this alternating way. In another operating state, the main signal transmission channel and the auxiliary signal transmission channel are both conductive, and the current is divided into two channels, making full use of the current change order in each signal transmission channel.

Figure 7:
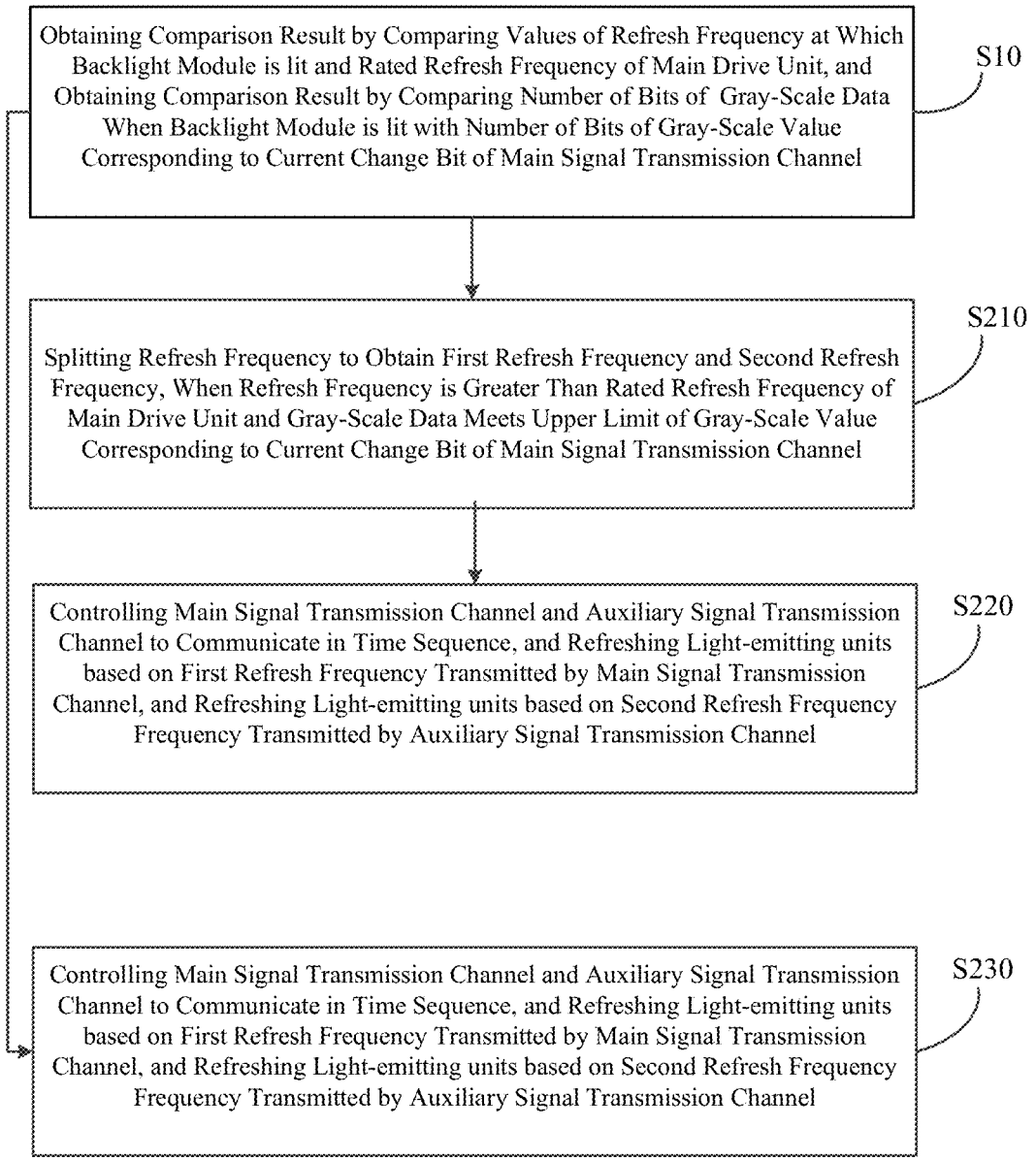
FIG. 7 is a flow diagram of step S230 in the present application.

Referring to FIG. 7, the step of controlling operating states of the main signal transmission channel and the auxiliary signal transmission channel according to the comparison result between the refresh frequency and the rated refresh frequency of the main drive unit and the comparison result between the gray-scale data and the gray-scale value corresponding to the current change bit of the main signal transmission channel further includes:

Step S230, controlling the main signal transmission channel and the auxiliary signal transmission channel to communicate with the light-emitting unit simultaneously, when the refresh frequency meets the rated refresh frequency of the main drive unit and the gray-scale data exceeds an upper limit of the gray-scale value corresponding to the current change bit of the main signal transmission channel. The two signal transmission channels are simultaneously turned on, so that the overall change order of the current flowing through the light-emitting unit increases exponentially. For example, the gray-scale data of a signal transmission channel is selected between 256 data, namely the 8th power of 2. That is, the change value of current represents 256 choices. If two signal transmission channels are opened simultaneously, it is equivalent to the superposition of two to the 8th power. That is, 2 to the 16th power, and a total of 65,536 gray-scale data can be selected. Therefore, the selectable range of current is increased, and the brightness of the light-emitting unit is more detailed.

In addition, the refresh frequency and gray-scale data may exceed the lighting ability of the backlight module. In this case, a third drive unit can be provided in the backlight module, and the third drive unit is connected with the auxiliary drive unit and the main drive unit in parallel, respectively. The third drive unit is provided with a third signal transmission channel. The main signal transmission channel and the auxiliary signal transmission channel is controlled to be conducted in time sequence, while the third signal transmission channel is kept in a state of constant conduction, so that the situation that the refresh frequency exceeds the rated refresh frequency can be met, and the current change order of gray-scale data exceeding a single signal transmission channel can also be met.

Figure 8:
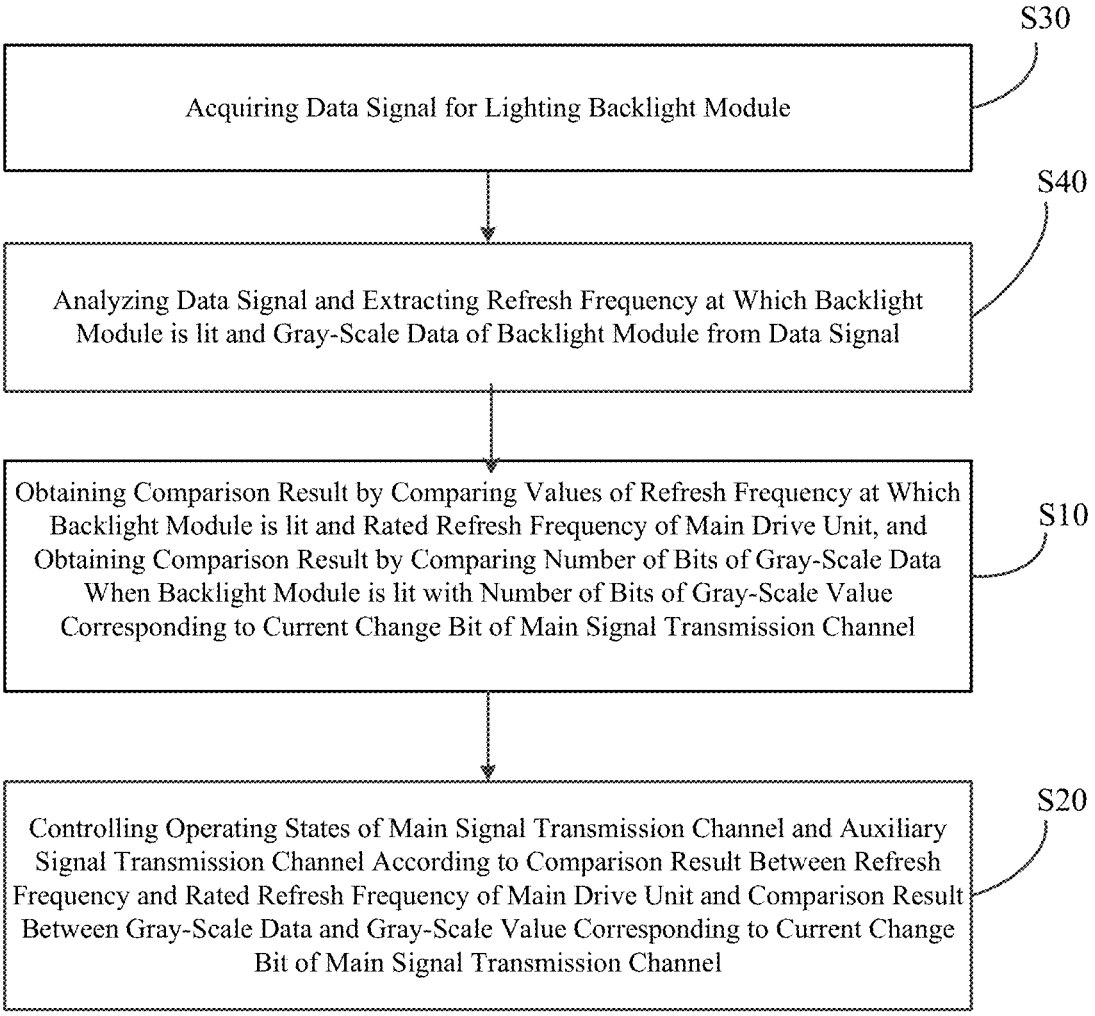
FIG. 8 is a flow diagram of steps S30 and S40 in the present application.

Referring to FIG. 8, before obtaining a comparison result by comparing values of between the refresh frequency at which the backlight module is lit and the rated refresh frequency of the main drive unit, the method includes:

Step S30, acquiring a data signal for lighting the backlight module; and

Step S40, analyzing the data signal and extracting the refresh frequency at which the backlight module is lit and the gray-scale data of the backlight module from the data signal.

The refresh frequency for lighting the backlight module and the gray-scale data of the backlight module come from the data signal. After receiving the data signal, the content of the data signal is analyzed and the data is extracted. It is convenient to compare the data for determining whether the main drive unit of the backlight module can meet the refresh frequency and gray-scale data, and if not, enable the auxiliary drive unit to intervene in the operation to allocate the data processing, thereby improving the processing capacity of the backlight module.

Embodiment 3

Figure 10:
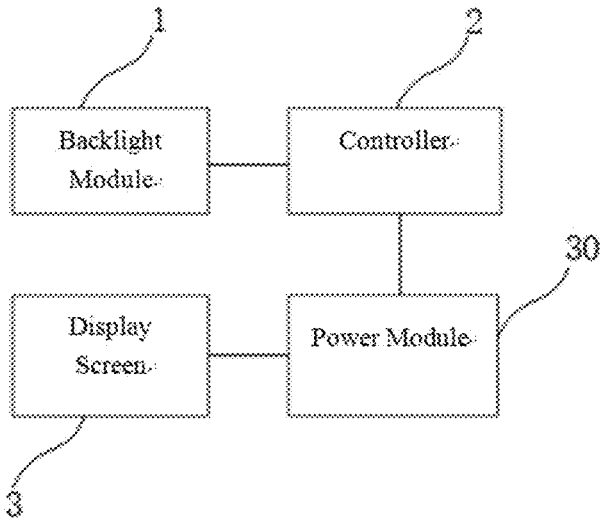
FIG. 10 is a schematic structural diagram of a display device according to a third embodiment of the present application.

Referring to FIG. 10, the present application also provides a display device. The display device includes a display screen 3 and a backlight module 1 arranged at one side of the display screen 3. The display device also has a power module 30 respectively connected to the controller 2 and the display screen 3 and used for supplying power to the display screen 3 and the backlight module 1.

The embodiment of the display device of the present application includes all the technical solutions of all the embodiments of the backlight module, and the achieves the same technical effects, which will not be repeated here.

While the present application has been described with reference to several exemplary embodiments, it should be understood that the terms used herein are illustrative and exemplary and are not limiting. Since the present application can be embodied in various forms without departing from the spirit or essence of the present application, it should therefore be understood that the foregoing embodiments are not limited to any of the foregoing details, but are to be interpreted broadly within the spirit and scope defined by the appended claims, so that all variations and modifications falling within the scope of the claims or their equivalents are to be covered by the appended claims.

What is claimed is:

1. A backlight module comprising: at least one light-emitting group, each of which comprises a main drive unit provided with a plurality of main signal transmission channels and a plurality of groups of light-emitting units, each of the main signal transmission channels being connected to a group of the light-emitting units, an auxiliary drive unit, wherein the auxiliary drive unit and the main drive unit are connected in parallel, the auxiliary drive unit is provided with a plurality of auxiliary signal transmission channels, the auxiliary signal transmission channels and the main signal transmission channels are arranged in parallel in one-to-one correspondence and are connected to the group of light-emitting units; and a controller connected to the main drive unit and the auxiliary drive unit, respectively, and configured to control operating states of the main signal transmission channel and the auxiliary signal transmission channel according to a refresh frequency and gray-scale data;

wherein in the main signal transmission channel and the auxiliary signal transmission channel arranged in parallel in one-to-one correspondence, the main signal transmission channel is connected to the light-emitting unit through a first control switch, and the auxiliary signal transmission channel is connected to the light-emitting unit through a second control switch;

wherein the controller is respectively connected to the first control switch and the second control switch, and is configured to control switching states of the first control switch and the second control switch according to the refresh frequency and gray-scale data, so as to adjust the operating states of the main signal transmission channel and the auxiliary signal transmission channel.

2. The backlight module according to claim 1, wherein the first control switch and the second control switch are transistor switches; wherein a first terminal of the first control switch is connected to the light-emitting unit, a second terminal of the first control switch is connected to the main drive unit, and a control terminal of the first control switch is connected to the controller; and wherein a first terminal of the second control switch is connected to the light-emitting unit, a second terminal of the second control switch is connected to the auxiliary drive unit, and a control terminal of the second control switch is connected to the controller.

3. The backlight module according to claim 1, wherein the light-emitting unit comprises a plurality of groups of lamp strings arranged side by side, wherein two adjacent lamp strings are arranged equidistantly, and the two adjacent lamp strings are connected end to end.

4. The backlight module according to claim 3, wherein the lamp string comprises a plurality of lamp beads sequentially connected in series, wherein a distance between pixel centers of two adjacent lamp beads is L, which satisfies: 0.3 mm≤L≤1.5 mm.

5. The backlight module according to claim 1, wherein the controller comprises:

a chip-on-board plate for acquiring a data signal for lighting the backlight module;

a time-sharing control unit for analyzing the data signal, and extracting the refresh frequency at which the backlight module is lit and the gray-scale data of the backlight module from the data signal, and comparing values of the refresh frequency at which the backlight module is lit and a rated refresh frequency of the main drive unit, and comparing number of bits of a gray-scale data when the backlight module is lit with number of bits of a gray-scale value corresponding to a current change bit of the main signal transmission channel; and a main control unit for controlling the operating states of the main signal transmission channel and the auxiliary signal transmission channel according to a comparison result between the refresh frequency and the rated refresh frequency of the main drive unit and the comparison result between the gray-scale data and the gray-scale value corresponding to the current change bit of the main signal transmission channel, wherein the time-sharing control unit is connected to the chip-on-board plate unit and the main control unit, respectively.

6. The backlight module according to claim 1, further comprising:

a third drive unit connected with the auxiliary drive unit and the main drive unit in parallel, wherein the third drive unit is provided with a third signal transmission channel.

7. A driving method of a backlight module, wherein the backlight module comprises at least one light-emitting group, wherein the light-emitting group comprises a main drive unit provided with a plurality of main signal transmission channels and an auxiliary drive unit provided with a plurality of auxiliary signal transmission channels, and the auxiliary signal transmission channels and the main signal transmission channels are arranged in parallel in one-to-one correspondence and connected to a same group of light-emitting units;

the driving method of the backlight module comprises: obtaining a comparison result by comparing values of a refresh frequency at which the backlight module is lit and a rated refresh frequency of the main drive unit, and obtaining a comparison result by comparing number of bits of a gray-scale data when the backlight module is lit with number of bits of a gray-scale value corresponding to a current change bit of the main signal transmission channel; and controlling operating states of the main signal transmission channel and the auxiliary signal transmission channel according to the comparison result between the refresh frequency and the rated refresh frequency of the main drive unit and the comparison result between the gray-scale data and the gray-scale value corresponding to the current change bit of the main signal transmission channel;

wherein the controlling operating states of the main signal transmission channel and the auxiliary signal transmission channel according to the comparison result between the refresh frequency and the rated refresh frequency of the main drive unit and the comparison result between the gray-scale data and the gray-scale value corresponding to the current change bit of the main signal transmission channel comprises:

splitting the refresh frequency to obtain a first refresh frequency and a second refresh frequency, when the refresh frequency is greater than the rated refresh frequency of the main drive unit and the gray-scale data meets an upper limit of the gray-scale value corresponding to the current change bit of the main signal transmission channel; and controlling the main signal transmission channel and the auxiliary signal transmission channel to communicate in time sequence, and refreshing the light-emitting units based on the first refresh frequency transmitted by the main signal transmission channel, and refreshing the light-emitting units based on the second refresh frequency transmitted by the auxiliary signal transmission channel.

8. The driving method of the backlight module according to claim 7, wherein the controlling operating states of the main signal transmission channel and the auxiliary signal transmission channel according to the comparison result between the refresh frequency and the rated refresh frequency of the main drive unit and the comparison result between the gray-scale data and the gray-scale value corresponding to the current change bit of the main signal transmission channel further comprises:

controlling the main signal transmission channel and the auxiliary signal transmission channel to communicate with the light-emitting unit simultaneously, when the refresh frequency meets the rated refresh frequency of the main drive unit and the gray-scale data exceeds an upper limit of the gray-scale value corresponding to the current change bit of the main signal transmission channel.

9. The driving method of the backlight module according to claim 7, wherein before obtaining a comparison result by comparing values of the refresh frequency at which the backlight module is lit and the rated refresh frequency of the main drive unit, the method comprises:

acquiring a data signal for lighting the backlight module; and analyzing the data signal and extracting the refresh frequency at which the backlight module is lit and the gray-scale data of the backlight module from the data signal.

10. A display device comprising:

a display screen;

a backlight module, disposed at one side of the display screen, comprising:

at least one light-emitting group, each of which comprises a main drive unit provided with a plurality of main signal transmission channels and a plurality of groups of light-emitting units, each of the main signal transmission channels being connected to a group of the light-emitting units, an auxiliary drive unit, wherein the auxiliary drive unit and the main drive unit are connected in parallel, the auxiliary drive unit is provided with a plurality of auxiliary signal transmission channels, the auxiliary signal transmission channels and the main signal transmission channels are arranged in parallel in one-to-one correspondence and are connected to the group of light-emitting units; and a controller connected to the main drive unit and the auxiliary drive unit, respectively, and configured to control operating states of the main signal transmission channel and the auxiliary signal transmission channel according to a refresh frequency and gray-scale data; and a power module connected to the controller and the display screen, respectively and configured to provide power for the display screen and the backlight module;

wherein in the main signal transmission channel and the auxiliary signal transmission channel arranged in parallel in one-to-one correspondence, the main signal transmission channel is connected to the light-emitting unit through a first control switch, and the auxiliary signal transmission channel is connected to the light-emitting unit through a second control switch;

wherein the controller is respectively connected to the first control switch and the second control switch, and is configured to control switching states of the first control switch and the second control switch according to the refresh frequency and gray-scale data, so as to adjust the operating states of the main signal transmission channel and the auxiliary signal transmission channel.

11. The display device according to claim 10, wherein the first control switch and the second control switch are transistor switches; wherein a first terminal of the first control switch is connected to the light-emitting unit, a second terminal of the first control switch is connected to the main drive unit, and a control terminal of the first control switch is connected to the controller; and wherein a first terminal of the second control switch is connected to the light-emitting unit, a second terminal of the second control switch is connected to the auxiliary drive unit, and a control terminal of the second control switch is connected to the controller.

12. The display device according to claim 10, wherein the light-emitting unit comprises a plurality of groups of lamp strings arranged side by side, wherein two adjacent lamp strings are arranged equidistantly, and the two adjacent lamp strings are connected end to end.

13. The display device according to claim 12, wherein the lamp string comprises a plurality of lamp beads sequentially connected in series, wherein a distance between pixel centers of two adjacent lamp beads is L, which satisfies: $0.3\ mm \leq L \leq 1.5\ mm$.

14. The display device according to claim 10, wherein the controller comprises:

a chip-on-board plate for acquiring a data signal for lighting the backlight module;

a time-sharing control unit for analyzing the data signal, and extracting the refresh frequency at which the backlight module is lit and the gray-scale data of the backlight module from the data signal, and comparing values of the refresh frequency at which the backlight module is lit and a rated refresh frequency of the main drive unit, and comparing number of bits of a gray-scale data when the backlight module is lit with number of bits of a gray-scale value corresponding to a current change bit of the main signal transmission channel; and a main control unit for controlling the operating states of the main signal transmission channel and the auxiliary signal transmission channel according to a comparison result between the refresh frequency and the rated refresh frequency of the main drive unit and the comparison result between the gray-scale data and the gray-scale value corresponding to the current change bit of the main signal transmission channel, wherein the time-sharing control unit is connected to the chip-on-board plate unit and the main control unit, respectively.

15. The display device according to claim 10, further comprising:

a third drive unit connected with the auxiliary drive unit and the main drive unit in parallel, wherein the third drive unit is provided with a third signal transmission channel.

* * * * *